US009596967B2

(12) United States Patent
Lee et al.

(10) Patent No.: US 9,596,967 B2
(45) Date of Patent: Mar. 21, 2017

(54) CLEANER AND CLEANER ACCESSORY

(71) Applicant: SAMSUNG ELECTRONICS CO., LTD., Suwon-si (KR)

(72) Inventors: Hyun Ju Lee, Gwangju (KR); See Hyun Kim, Gwangju (KR); Hyeon Cheol Kim, Gwangju (KR); Han Saem Lee, Seongnam-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 35 days.

(21) Appl. No.: 14/280,969

(22) Filed: May 19, 2014

(65) Prior Publication Data

US 2014/0338146 A1 Nov. 20, 2014

(30) Foreign Application Priority Data

May 20, 2013 (KR) ..... 10-2013-0056257

(51) Int. Cl.

| | |
|---|---|
| ***A47L 9/06*** | (2006.01) |
| ***A47L 9/00*** | (2006.01) |
| ***A47L 5/36*** | (2006.01) |
| ***A47L 9/24*** | (2006.01) |

(52) U.S. Cl.

CPC ..... *A47L 9/0027* (2013.01); *A47L 5/362* (2013.01); *A47L 9/0606* (2013.01); *A47L 9/068* (2013.01); *A47L 9/0613* (2013.01); *A47L 9/0633* (2013.01); *A47L 9/0653* (2013.01); *A47L 9/0673* (2013.01); *A47L 9/242* (2013.01)

(58) Field of Classification Search

CPC ..... A47L 9/0606; A47L 9/068; A47L 9/0613; A47L 9/0633; A47L 9/0653; A47L 9/0027

IPC ..... A47L 9/06

See application file for complete search history.

(56) References Cited

U.S. PATENT DOCUMENTS 6,820,305 B2 * 11/2004 Albert ..... A47L 9/06 15/398
2009/0188067 A1 * 7/2009 White ..... A47L 9/02 15/246.2

FOREIGN PATENT DOCUMENTS

WO 02/067748 A1 9/2002

OTHER PUBLICATIONS

European Search Report dated Aug. 22, 2014 and issued in corresponding European Patent Application 14159387.1.
Extended European Office Action dated Oct. 11, 2016 in corresponding European Patent Application No. 14 159 387.1.

* cited by examiner

*Primary Examiner* — David Redding
(74) *Attorney, Agent, or Firm* — Staas & Halsey LLP

(57) ABSTRACT

A cleaner including a body configured to generate a suction force, a suction head configured to suction air and dirt while making contact with a cleaning surface, a handle pipe configured for manipulation by a user, a flexible hose connecting the handle pipe to the body, an extension pipe connecting the suction head to the handle pipe, and an accessory assembly coupled to the handle pipe to perform a cleaning in place of the suction head, the accessory assembly comprising an accessory body, a Dusting tool on which a brush is mounted, a Crevice tool to clean a gap, and an Upholstery tool to clean fabrics, the Upholstery tool being rotatably coupled to the accessory body, thereby enhancing the convenience of use and cleaning efficiency.

19 Claims, 13 Drawing Sheets

CLEANER AND CLEANER ACCESSORY

CROSS-REFERENCE TO RELATED APPLICATIONS

This application claims the benefit of Korean Patent Application No. 10-2013-0056257 , filed on May 20, 2013 , in the Korean Intellectual Property Office, the disclosure of which is incorporated herein by reference.

BACKGROUND

1. Field

Embodiments of the present disclosure relate to a cleaner provided with an accessory.

2. Description of the Related Art

In general, a vacuum cleaner includes a body generating a suction force, a suction head suctioning air and dirt while coming into contact with a cleaning surface, a handle pipe for user manipulation, an extension pipe connecting the suction head to the handle pipe, and a flexible hose connecting the handle pipe to the body, to perform a cleaning task.

Such a cleaner may be provided with various accessories that can perform a cleaning task instead of the suction head, depending on the type and state of the cleaning surface.

The accessory includes a crevice attachment provided in a flat shape to clean a narrow gap, a dusting attachment having a brush mounted thereon to clean a window frame and a corner, and an upholstery attachment to clean fabrics, all of which are provided as separate attachments that must be individually attached to the handle pipe, one attachment at a time.

SUMMARY

Therefore, it is an aspect of the present disclosure to provide a cleaner provided with an accessory assembly capable of enhancing the working efficiency during a cleaning task and convenience of use while having a Crevice tool, a Dusting tool and an Upholstery tool integrally formed with one another.

It is another aspect of the present disclosure to provide a cleaner capable of easily keeping an accessory assembly.

Additional aspects of the disclosure will be set forth in part in the description which follows and, in part, will be obvious from the description, or may be learned by practice of the disclosure.

In accordance with one aspect of the present disclosure, a cleaner includes a body, a handle pipe, a flexible hose, an extension pipe, and an accessory assembly. The body may be configured to generate a suction force. The suction head may be configured to suction air and dirt while making contact with a cleaning surface. The handle pipe may be configured for manipulation by a user. The flexible hose may connect the handle pipe to the body. The extension pipe may connect the suction head to the handle pipe. The accessory assembly may be coupled to the handle pipe to perform a cleaning in place of the suction head. The accessory assembly may include an accessory body, a Dusting on which a brush is mounted, a Crevice to clean a gap, and an Upholstery to clean fabrics, the Upholstery being rotatably coupled to the accessory body.

The Upholstery may include a rotating shaft that protrudes so as to be coupled to the accessory body. The accessory body may include a rotating shaft accommodation part into which the rotating shaft is inserted to allow the Upholstery to be rotatably coupled to the accessory body.

The accessory body may include a stopper part to limit a range of rotation of the Upholstery.

The Crevice may be coupled to one end of the accessory body. The Upholstery may be coupled to other end of the accessory body so as to be provided at an opposite side of the Crevice with respect to the accessory body.

The Dusting may be coupled to an interior portion of the accessory body so as to be slid toward the Upholstery.

The accessory body may include a guide hole configured to guide a movement of the Dusting, and the Dusting may include a manipulation part that is movable along the guide hole to be pressed by the user.

The accessory body may further include a locking hole provided at both ends in a longitudinal direction of the guide hole to lock the Dusting.

The handler pipe may be provided with a holder part to which the manipulation part is coupled. The accessory assembly may be supported by the handle pipe as the manipulation part is coupled to the holder part.

The holder part may include an accommodation groove, and the manipulation part may include an insertion protrusion that is inserted into the accommodation groove.

The Crevice may be rotatably coupled to the accessory body.

In accordance with another aspect of the present disclosure, a cleaner includes a body, a suction head, a handle pipe, a flexible hose, an extension pipe, and an accessory assembly. The body may be configured to generate a suction force. The suction head may be configured to suction air and dirt while making contact with a cleaning surface. The handle pipe may be configured for manipulation by a user. The flexible hose may connect the handle pipe to the body. The extension pipe may connect the suction head to the handle pipe. The accessory assembly may be coupled to the handle pipe to perform a cleaning in place of the suction head. The accessory assembly may include an accessory body, a Dusting on which a brush is mounted, a Crevice to clean a gap, and an Upholstery to clean fabrics, the Crevice being rotatably coupled to the accessory body.

The accessory body may include an annular groove, and the Crevice may include a coupling protrusion inserted into the annular groove.

A central axis of the accessory body may be not provided in line with a rotation axis of the Crevice.

The Crevice may include a cap part rotatably coupled to the accessory body, and a nozzle part extending from the cap part.

The rotation axis of the Crevice may be not provided in line with a central axis of the nozzle part.

The Crevice may be rotatably coupled to the accessory body through a universal joint.

The Crevice may include a ball part having a spherical shape, and the accessory body may include a ball housing to support and surround the ball part.

The ball part may include an opening allowing an inside passage of the Crevice to communicate with an inside passage of the accessory body.

The cleaner may further include a packing member that may be coupled between the ball part and the ball housing to maintain airtightness inside passages of the ball part and the ball housing while supporting the ball part.

As described above, the cleaner is provided with an accessory assembly having three types of accessories, including a Crevice, a Dusting and an Upholstery, which are integrally formed with one another, so that a user can efficiently perform a cleaning task depending on a cleaning surface.

In addition, the Upholstery is rotatably provided so as to be kept in a state of coming into close contact with the cleaning surface when the handle pipe is pushed and pulled, thereby enhancing the cleaning efficiency and convenience of use.

In addition, the Crevice is rotatably provided to easily adjust the direction the nozzle part of the Crevice, thereby enhancing the cleaning efficiency and convenience of use.

In addition, an adjusting part to adjust the movement of the dust is coupled to the holder part provided on the handle pipe, so that the accessory assembly is supported by the handle pipe, thereby facilitating the storage of the accessory assembly.

In accordance with another aspect of the present disclosure, an apparatus is configured to attach to a handle pipe of a vacuum cleaner. The apparatus may include an accessory assembly to perform a cleaning in place of a suction head of the vacuum cleaner, the accessory assembly comprising an accessory body, a Dusting on which a brush is mounted, a Crevice to clean a gap, and an Upholstery to clean fabrics, the Upholstery being rotatably coupled to the accessory body, wherein each of the accessory body, the Dusting, the Crevice, and the Upholstery are integrally formed with each other as a single unit.

In accordance with another aspect of the present disclosure, an accessory assembly is configured to perform cleaning in place of a suction head of a vacuum cleaner. The accessory assembly may include an accessory body, a Dusting on which a brush is mounted, a Crevice to clean a gap, and an Upholstery to clean fabrics, wherein the Upholstery is rotatably coupled to the accessory body, and wherein each of the accessory body, the Dusting, the Crevice, and the Upholstery are integrally formed with each other as a single unit.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
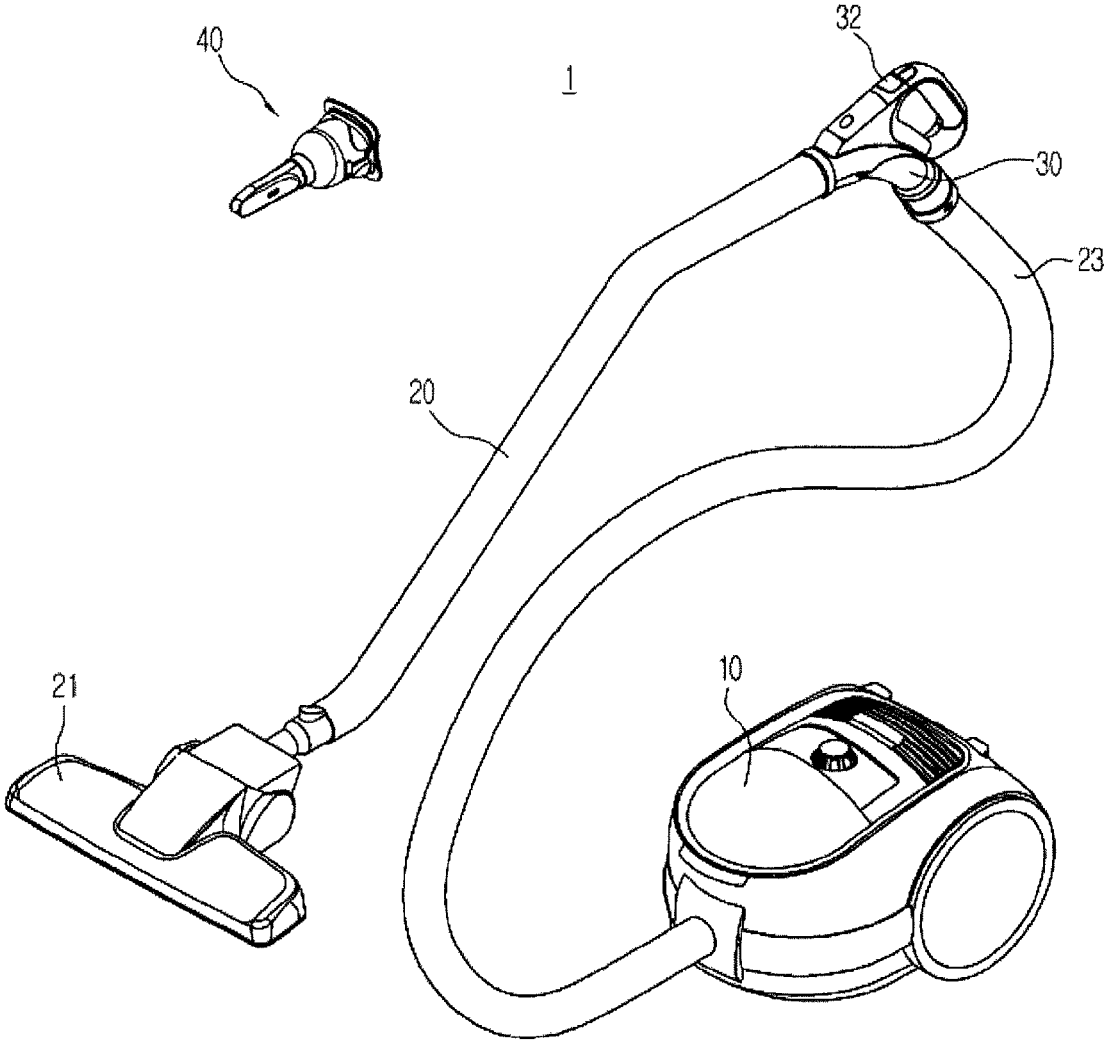
FIG. 1 is a drawing illustrating a whole configuration of a cleaner in accordance with a first embodiment of the present disclosure.

Reference will now be made in detail to the embodiments of the present disclosure, examples of which are illustrated in the accompanying drawings, wherein like reference numerals refer to like elements throughout.

FIG. 1 is a drawing illustrating a whole configuration of a cleaner in accordance with a first embodiment of the present disclosure.

Referring to FIG. 1, a cleaner 1 includes a body 10 to generate a suction force, a suction head 21 to suction air and dirt while making contact with a cleaning surface, a handle pipe 30 for manipulation by a user, an extension pipe 20 connecting the suction head 21 to the handle pipe 30, a flexible hose 23 connecting the handle pipe 30 to the body 10, and an accessory assembly 40 coupled to the handle pipe 30 in place of the suction head 21 to perform a cleaning task.

The body 10 is provided with a fan motor apparatus (not shown) to generated suction force, and a dust collecting apparatus (not shown) to filter dirt from the suctioned air.

The suction head 21 suctions air and dirt by the suction force generated from the body 10. The suction head 21 may be provided in a flat shape to make contact with a hard floor, for example, a wooden floor, or carpet.

The air and dirt suctioned through the suction head 21 is guided to the extension pipe 20. The extension pipe 20 may be a pipe formed of a resin or metal.

The handle pipe 30 may be detachably coupled to an end of the extension pipe 20. A user may easily manipulate the direction of the suction head 21 and the extension pipe 20 while gripping the handle pipe 30. Various manipulation buttons 32 may be provided on the handle pipe 30 to select a function of the cleaner 1.

The flexible hose 23 is provided between the handle pipe 30 and the body 10. The flexible hose 23 is formed of flexible resin such that the handle pipe 30 is freely moved.

According to such a configuration, the air and dirt of the cleaning surface are suctioned to the suction head 21 by the suction force generated from the body 10, and then are guided to the body 10 while sequentially passing through the extension pipe 20, the handle pipe 30 and the flexible hose 23. The dirt of suctioned air is filtered in the body 10, and the filtered air is discharged to the outside of the body 10.

The accessory assembly 40 is configured to clean a cleaning surface, such as a narrow gap and a corner, and fabrics in place of the suction head 21 that has a relatively flat shape.

The accessory assembly 40 is coupled to the handle pipe 30 in place of the extension pipe 20. When the accessory assembly 40 needs to be used, the extension pipe 20 is separated from the handle pipe 30, and the accessory assembly 40 is coupled to the handle pipe 30 to use. On the contrary, when a general cleaning task needs to be performed using the suction head 21 again, the accessory assembly 40 is separated from the handle 30 and the extension pipe 20 is coupled to the handle pipe 30 to perform the cleaning.

A more detailed description of the accessory assembly 40 will be made later. However, in brief, the accessory assembly 40 includes a Dusting tool (also referred to herein as a Dusting) (60 in FIG. 3) having a brush mounted thereon to clean a window frame or a corner, a Crevice tool (also referred to herein as a Crevice) (70 in FIG. 3) provided in a flat and sharp shape to clean a narrow gap, and an Upholstery tool (also referred to herein as an Upholstery) (80 in FIG. 3) having a relatively short brush to clean fabrics such as a sofa, bedclothes, and clothing. In addition, these three accessories are integrally formed with one another into a single unit. For example, any two or more of the three accessories may be constructed of a common material such as plastic and integrally formed as a single piece attachment. Accordingly, the accessory assembly 40 maybe referred to as having a 3 in 1 structure.

In addition, the accessory assembly 40 in accordance with embodiments of the present disclosure further includes an improved structure to enhance the convenience of use and the cleaning efficiency. Hereinafter, the configuration and operation of the accessory assembly 40 in embodiments of the present disclosure will be described.

Figure 2:
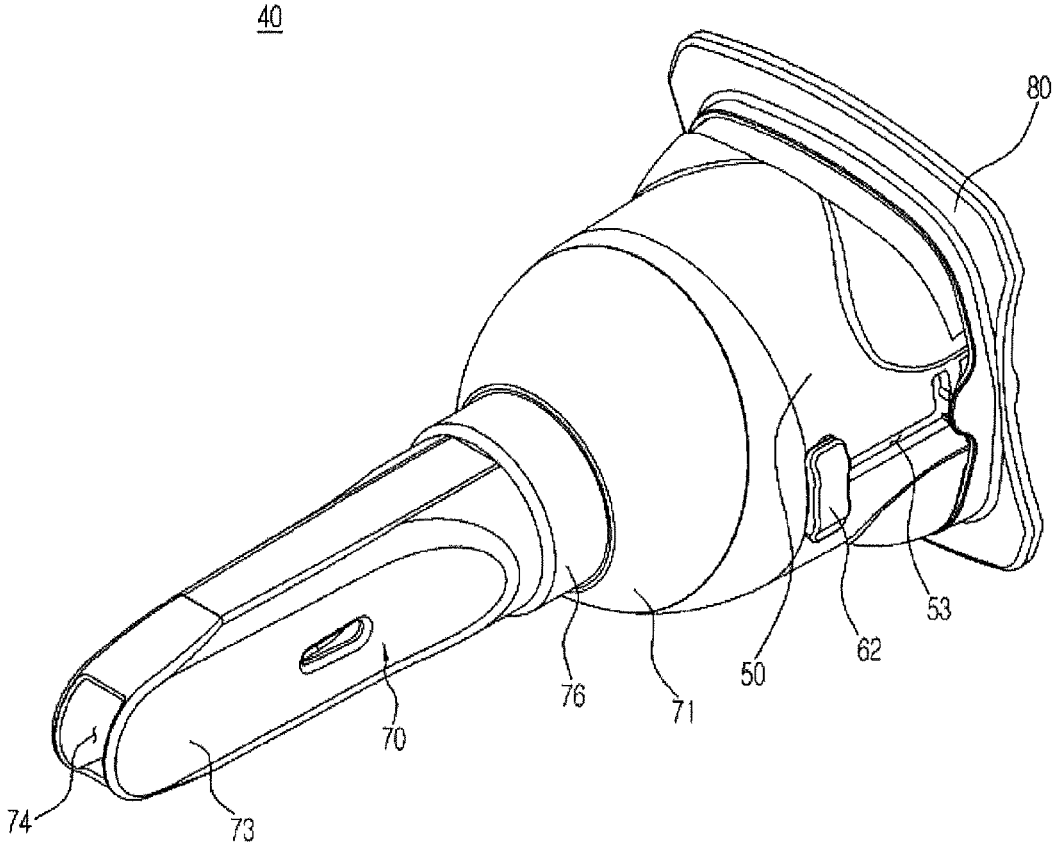
FIG. 2 is a drawing illustrating an external appearance of an accessory assembly of the cleaner in accordance with the first embodiment of the present disclosure.
Figure 3:
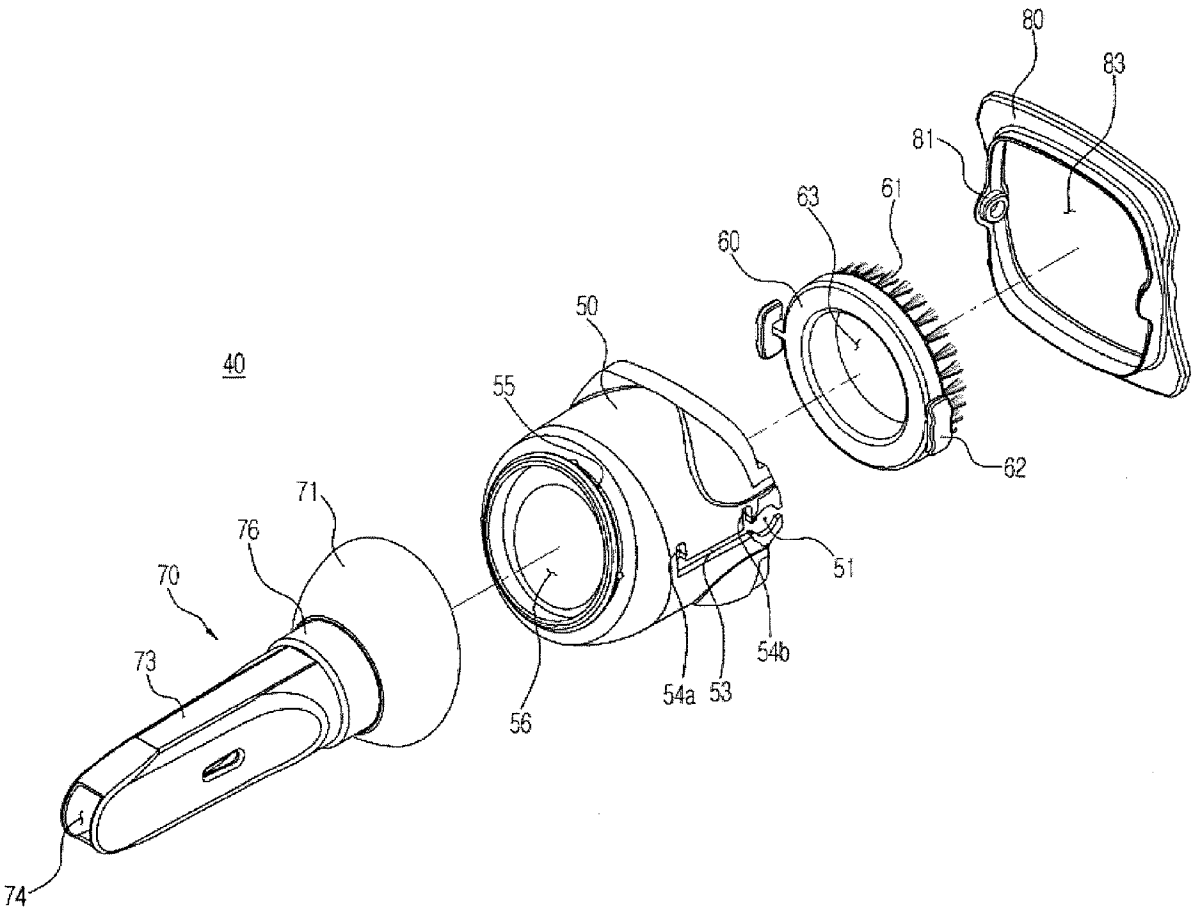
FIG. 3 is an exploded perspective view illustrating the configuration of the accessory assembly of the cleaner in the first embodiment of the present disclosure that is exploded.
Figure 4:
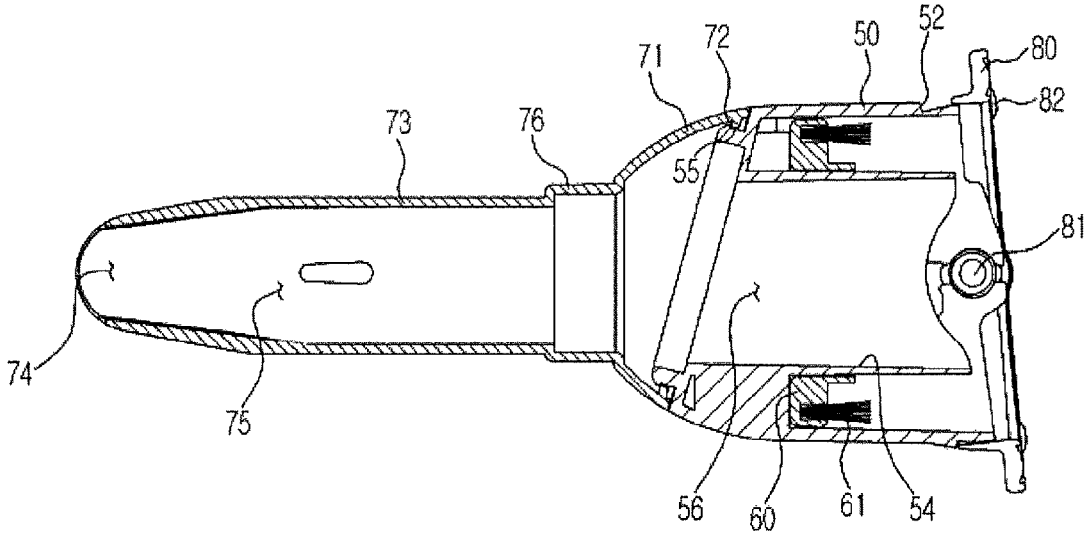
FIG. 4 is a cross section view illustrating the accessory assembly of the cleaner in the first embodiment of the present disclosure.
Figure 5:
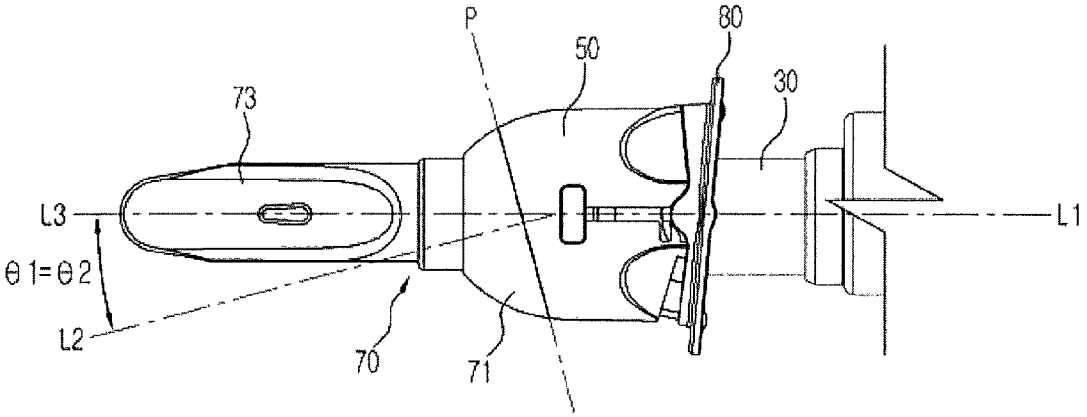
FIGS. 5 and 6 are drawings illustrating a state of a Crevice being used in the cleaner in the first embodiment of the present disclosure.
Figure 6:
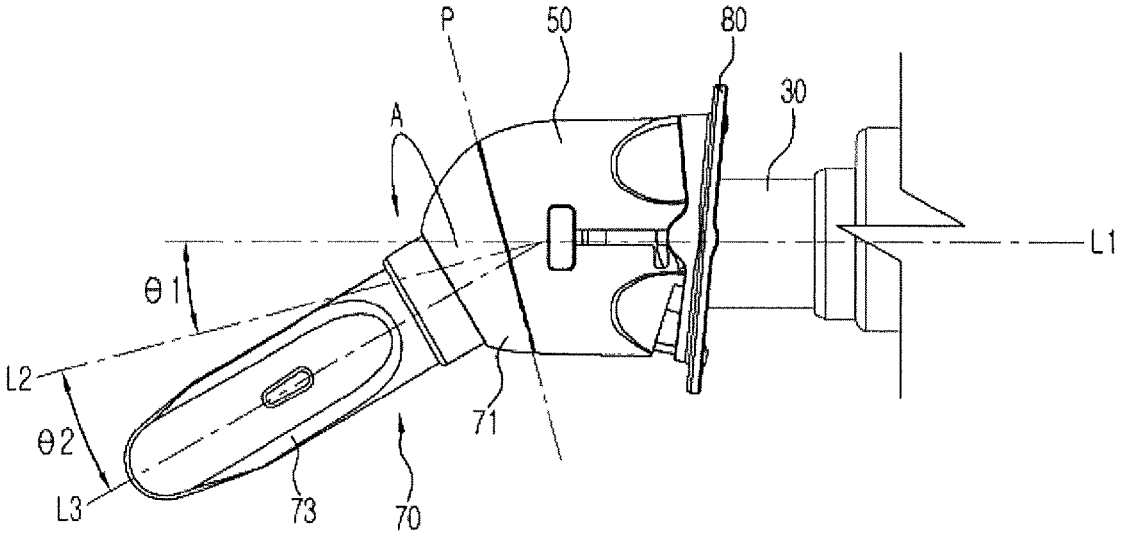
Figure 7:
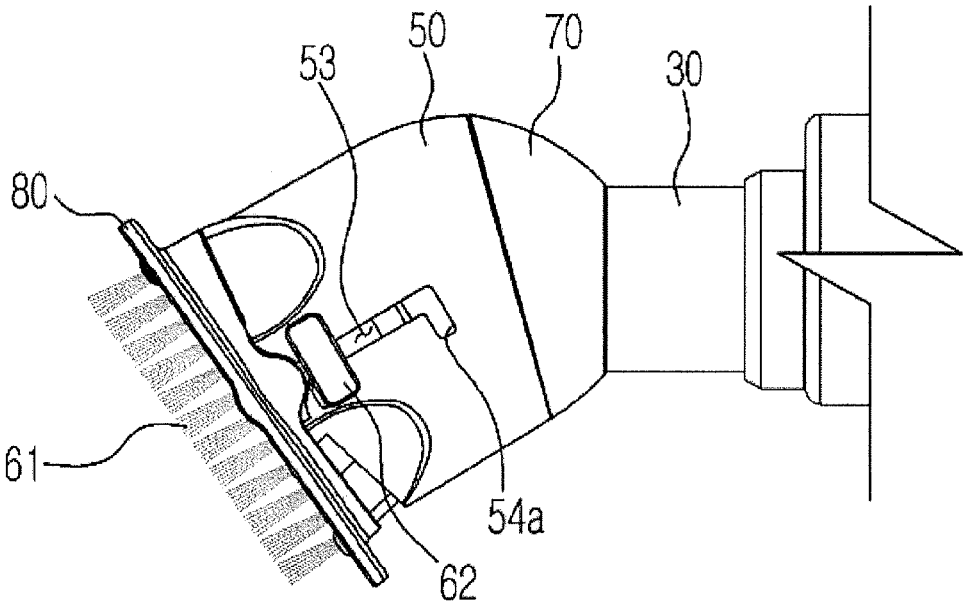
FIG. 7 is a drawing illustrating a state of a Dusting being used in the cleaner in the first embodiment of the present disclosure.
Figure 8:
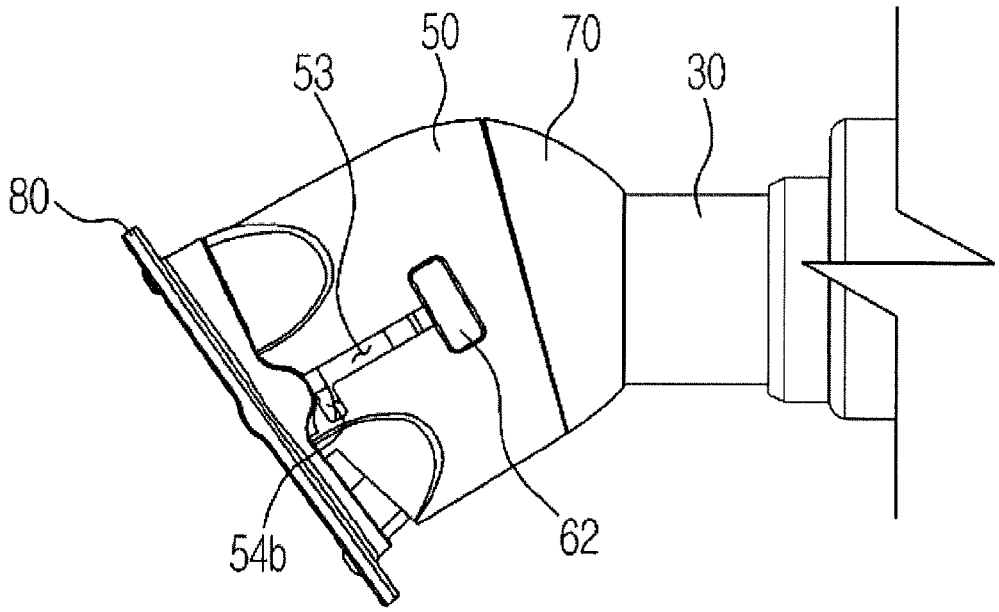
FIGS. 8 and 9 are drawings illustrating a state of an Upholstery being used in the cleaner in the first embodiment of the present disclosure.
Figure 9:
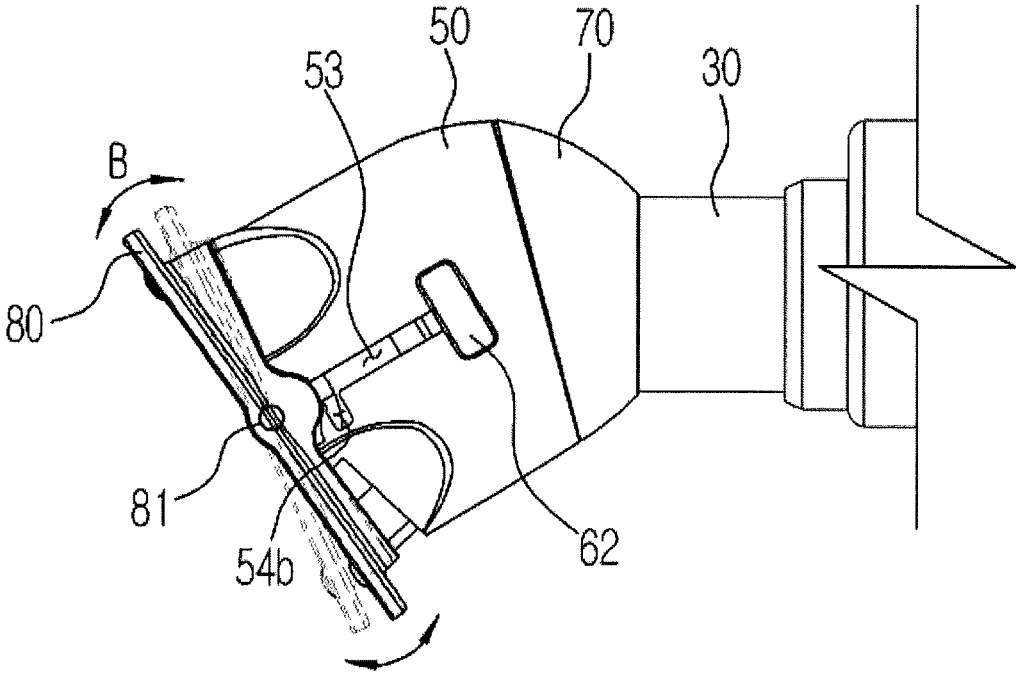

FIG. 2 is a drawing illustrating an external appearance of an accessory assembly of the cleaner in accordance with the first embodiment of the present disclosure, FIG. 3 is an exploded perspective view illustrating the configuration of the accessory assembly of the cleaner in the first embodiment of the present disclosure that is exploded, FIG. 4 is a cross section view illustrating the accessory assembly of the cleaner in the first embodiment of the present disclosure, FIGS. 5 and 6 are drawings illustrating a state of a Crevice being used in the cleaner in the first embodiment of the present disclosure, FIG. 7 is a drawing illustrating a state of a Dusting being used in the cleaner in the first embodiment of the present disclosure, and FIGS. 8 and 9 are drawings illustrating a state of an Upholstery being used in the cleaner in the first embodiment of the present disclosure.

Referring to FIGS. 2 to 6, the accessory assembly 40 may include, for example, an accessory body 50, the Upholstery 80, the Crevice 70, and the Dusting 60.

The accessory body 50 is provided in an approximately cylindrical shape, and is provided at an inside thereof with a passage 56. The accessory body 50 may be provided with a first coupling part 54 that enables the accessory assembly 40 to be coupled to the handle pipe 30 when the Crevice 70 needs to be used. The handle pipe 30 may be insertedly coupled to the first coupling part 54.

The Upholstery 80 is rotatably coupled to one end of the accessory body 50. To this end, the Upholstery 80 is provided with a rotating shaft 81 protruding to couple to the accessory body 50, and the accessory body 50 is provided with a rotating shaft accommodation part 51 into which the rotating shaft 81 may be rotatably inserted. The rotating shaft accommodation part 51 may be a groove or a hole into which the rotating shaft 81 is rotatably accommodated. The rotating shaft 81 of the Upholstery 80 is coupled to the rotating shaft accommodation part 51 of the accessory body 50 so as to enable an idle rotation of the Upholstery 80.

Accordingly, the Upholstery 80 may rotate by itself while having the rotating shaft 81 as a center of rotation when the handle pipe 30 is pushed or pulled, so that the Upholstery 80 comes into close contact with the cleaning surface. The Upholstery 80, which is rotatably coupled to the rotating shaft 81 so as to enable an idle operation, is rotated by the pressing against the cleaning surface. Accordingly, the cleaning efficiency is enhanced, and a motion of using a wrist to make the Upholstery 80 coming into close contact with the cleaning surface is not required, so that user convenience is improved.

Such an Upholstery 80 may be provided at the outside of the accessory body 50 to surround the accessory body 50. Accordingly, the Upholstery 80 is visible so that the operation and position of the Upholstery 80 may be easily recognized by the user.

Figure 11:
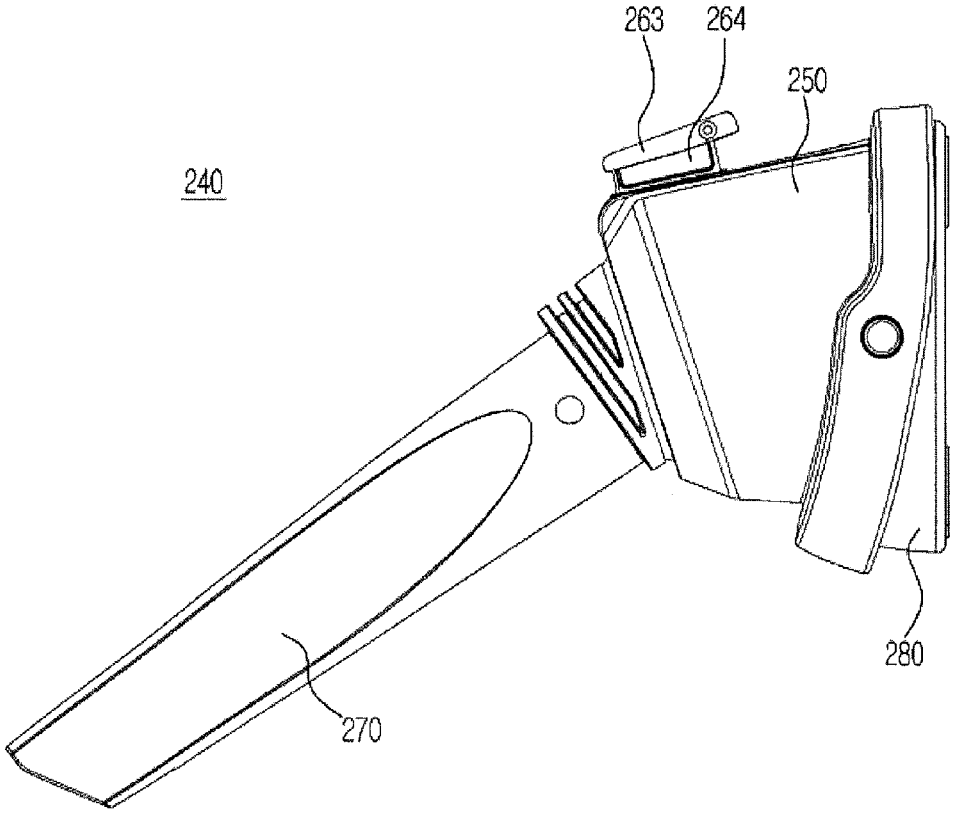
FIG. 11 is a side view illustrating an accessory assembly of a cleaner in a third embodiment of the present disclosure.
Figure 12:
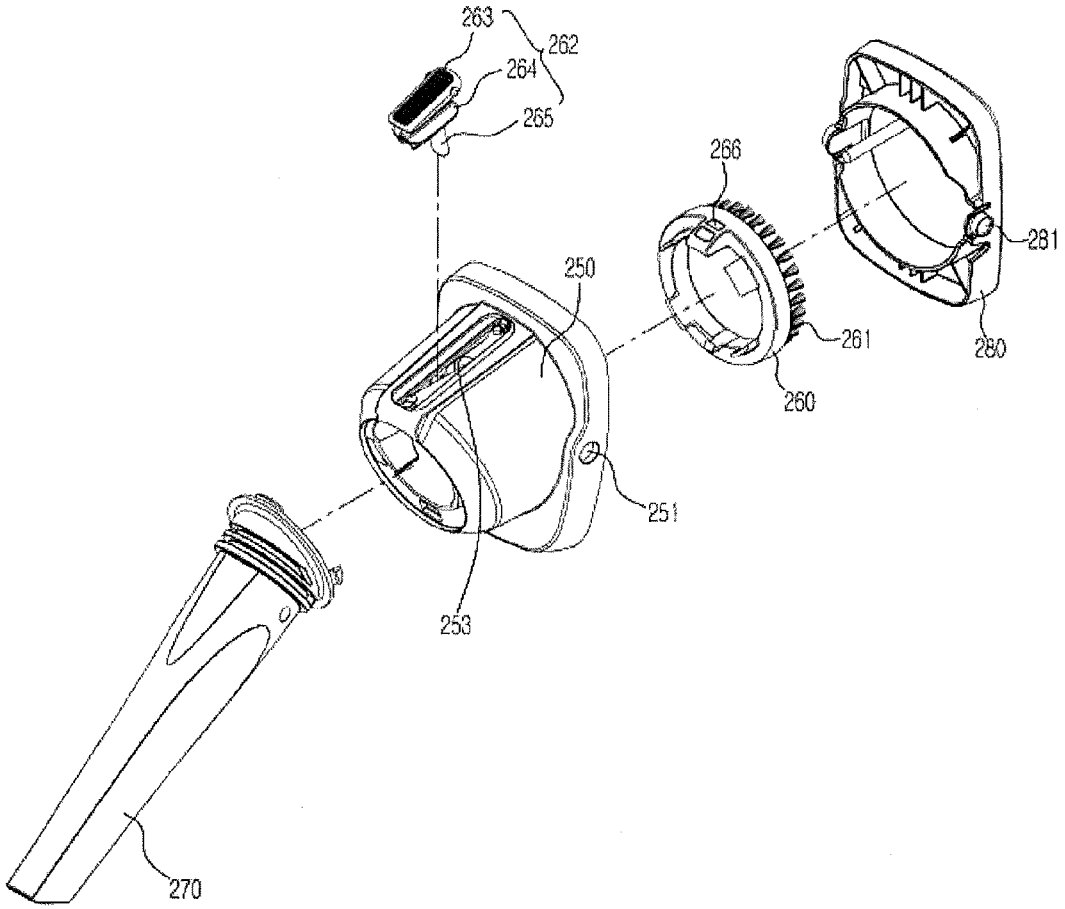
FIG. 12 is an exploded perspective view illustrating the configuration of the accessory assembly of the cleaner in the third embodiment of the present disclosure that is exploded.

However, the position of the Upholstery 80 is not limited to the outside of the accessory body 50, and in accordance with a third embodiment of the present disclosure shown in FIGS. 11 and 12, an Upholstery 80 may be provided inside an accessory body 250.

Meanwhile, the accessory body 50 may be provided with a stopper part (52 in FIG. 4) to limit a range of rotation of the Upholstery 80. In a case in which the Upholstery 80 is provided to be rotatable by 360 degrees without restriction, the convenience of use may be degraded. Accordingly, the stopper part 52 appropriately limits a range of rotation of the Upholstery 80. The stopper part 52 may be a protrusion 52 protruding from an outer surface of the accessory body 50.

The Upholstery 80 may be provided with a brush for dusting tasks (82 in FIG. 4) such as to remove any lint or hair attached to fabrics.

The Crevice 70 may be coupled to the other end of the accessory body 50 so as to be provided at an opposite side of the Upholstery 80 with respect to the accessory body 50.

The Crevice 70 includes a cap part 71 coupled to the accessory body 50, and a nozzle part 73 that extends from the cap part 71 while having a suction port 74 to suction air and dirt from the cleaning surface.

The nozzle part 73 may be provided with a second coupling part 76 that is configured to couple the accessory assembly 40 to the handle pipe 30 when the Upholstery 80 or the Dusting 60 needs to be used. The second coupling part 76 may be insertedly coupled to the handle pipe 30.

Meanwhile, the Crevice 70 may be rotatably coupled to the accessory body 50. To this end, the accessory body 50 may be provided with an annular groove 55, and the Crevice 70 may be provided with a coupling protrusion (72 in FIG. 4) inserted into the annular groove 55. Accordingly, as the coupling protrusion 72 moves along the annular groove 55, the Crevice 70 is rotatable with respect to the accessory body 50.

Herein, referring to FIGS. 5 and 6, a central axis L1 of the accessory body 50 need not be provided in a direct line with a rotation axis L2 of the Crevice 70. That is, the central axis L1 of the accessory body 50 may be provided to be inclined at a predetermined angle θ1 with respect to the rotation axis L2 of the Crevice 70. In a different point of view, a coupling surface P of the accessory body 50 and the Crevice 70 may be not perpendicular to the central axis L1 of the accessory body 50.

As described above, the Crevice 70 is provided to be inclined with respect to the accessory body 50, thereby facilitating an operation orienting the Crevice 70 toward the cleaning surface.

In addition, the rotation axis L2 of the Crevice 70 may not be provided in line with a central axis L3 of the nozzle part 73. That is, the rotation axis L2 of the Crevice 70 may be provided to be inclined at a predetermined angle θ2 with respect to the central axis L3 of the nozzle part 73 of the Crevice 70.

As described, the rotation axis L2 of the Crevice 70 is not provided in line with the central axis L3 of the nozzle part 73 of the Crevice 70, and when the Crevice 70 rotates on the rotation axis L2, the direction of the nozzle part 73 is converted so that a cleaning range is expanded in practice according to the rotation of the Crevice 70.

Meanwhile, in this embodiment of the present disclosure, the angle θ1 between the central axis L1 of the accessory body 50 and the rotation axis L2 of the Crevice 70 is illustrated as the same as the angle θ2 between the rotation axis L2 of the Crevice 70 and the central axis L3 of the nozzle part 73, but the present disclosure is not limited thereto. For example, the angle θ1 may be different from the angle θ2.

Referring to FIG. 7, the Dusting 60 is slidably coupled to the inside of the accessory body 50 such as an interior portion of the accessory body 50. The Dusting 60 is provided with a brush 61 mounted thereon, and the Dusting 60 may be provided so as to be movable to the Upholstery 80 such that the brush 61 protrudes outward beyond the Upholstery 80.

To this end, the accessory body 50 is provided with a guide hole 53 formed in a longitudinal direction of the accessory body 50 to guide the movement of the Dusting 60, and the Dusting 60 may be provided with a manipulation part 62 that is moved along the guide hole 53 and pressed by a user.

The guide hole 53 is provided at both ends thereof with locking holes 54*a* and 54*b* to lock the manipulation part 62.

Hereinafter, the operation of use of the accessory assembly 40 in accordance with the first embodiment of the present disclosure will be described with reference to FIGS. 1 to 9.

First, when a space having a thin gap needs to be cleaned, the Crevice 70 may be used. When the Crevice 70 needs to be used, the extension pipe 20 is separated from the handle pipe 30, and the accessory assembly 40 is coupled to the handle pipe 30. In this case, the handle pipe 30 is insertedly coupled to the first coupling part (54 in FIG. 4) provided on the accessory body 50.

As shown in FIGS. 5 and 6, the user may adjust the angle between the Crevice 70 and the accessory body 50 by appropriately rotating (A) the Crevice 70 while using the Crevice 70. Accordingly, the cleaning may be efficiently and conveniently performed depending on the location and structure of the cleaning surface.

Second, when a corner or a window frame needs to be cleaned, the Dusting 60 may be used. When the Dusting 60 needs to be used, the extension pipe 20 is separated from the handle pipe 30, and the accessory assembly 40 is coupled to the handle pipe 30. In this case, the second coupling part (76 in FIG. 2) provided on the Crevice 70 is insertedly coupled to the handle pipe 30.

As shown in FIG. 7, the user moves the manipulation part 62 of the Dusting 60 to an outer side along the guide hole 53 such that the brush 61 protrudes outward beyond the Upholstery 80 to perform a cleaning.

Third, when fabrics, such as a sofa, bedclothes, and clothing need to be cleaned, the Upholstery 80 may be used. IWhen the Upholstery 80 needs to be used, the extension pipe 20 is separated from the handle pipe 30, and the accessory assembly 40 is coupled to the handle pipe 30. In this case, the second coupling part (76 in FIG. 2) provided on the Crevice 70 is insertedly coupled to the handle pipe 30.

As shown in FIGS. 8 and 9, the user may move the manipulation part 62 of the Dusting 60 to an inner side along the guide hole 53 such that the brush 61 of the Dusting 60 does not protrude outward beyond the Upholstery 80, and may then perform cleaning.

As the handle pipe 30 is pushed and pulled, the Upholstery 80 rotates (B) by itself on the rotation shaft 81 by the pressing and contacting that occurs with respect to the cleaning surface, to maintain close contact with the cleaning surface, so that the user may conveniently and efficiently perform the cleaning.

Figure 10:
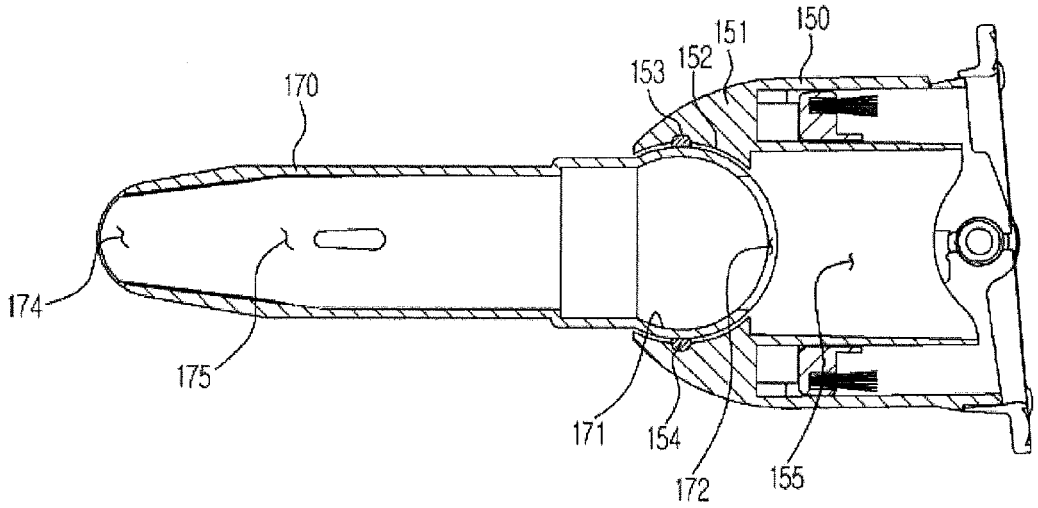
FIG. 10 is a cross section view illustrating an accessory assembly of a cleaner in a second embodiment of the present disclosure.

FIG. 10 is a cross section view illustrating an accessory assembly of a cleaner in a second embodiment of the present disclosure.

Hereinafter, an accessory assembly of a cleaner in accordance with the second embodiment of the present disclosure will be described with reference to FIG. 10. In the following description, the same reference numerals will be assigned to the parts of the present embodiment that are identical to those of previous embodiment, and details of parts will be omitted in order to avoid redundancy.

Referring to FIG. 10, the configuration of the accessory assembly in accordance with the second embodiment of the present disclosure is identical to that of the first embodiment of the present disclosure except for a coupling structure of a Crevice 170 and an accessory body 150.

In detail, the Crevice 170 is rotatably coupled to the accessory body 150, through a universal joint. That is, when compared to the first embodiment in which the Crevice 70 moves on a plane in a way that the suction port 74 thereof follows a certain circle, the Crevice 170 in accordance with the second embodiment of the present disclosure moves in a three-dimensional space while having a suction port 174 thereof following a certain sphere. Accordingly, the Crevice 170 in accordance with the second embodiment of the present disclosure may cover a broader range than the Crevice 70 in accordance with the first embodiment of the present disclosure.

The universal joint may employ a variety of structures, including some that are generally known in the art. For example, the universal joint may include a ball part 171 provided on the Crevice 170, and a ball housing 151 provided on the accessory body 150 to accommodate the ball part 171.

The ball part 171 may be provided at a rear end of the Crevice 170 in a spherical shape, and is rotatably accommodated in the ball housing 151 of the accessory body 150.

The ball part 171 has an opening 172 allowing an inside passage 175 of the Crevice 170 to communicate with an inside passage 155 of the accessory body 150. Accordingly, the air and dirt suctioned from the cleaning surface through the suction port 174 of the Crevice 170 are moved to the inside passage 155 of the accessory body 150 while passing through the inside passage 175 of the Crevice 170 and the opening 172.

The ball housing 151 is provided at an inner circumferential surface 152 thereof with a packing member insertion groove 153. A packing member 154 is provided on the packing member insertion groove 153 to come into close contact with the ball part 171 and the ball housing 151 to prevent the ball part 161 from unintentionally rotating inside the ball housing 151 while maintaining the airtightness of the inside passage 175 of the ball part 171 and the inside passage 155 of the ball housing 151.

Figure 13:
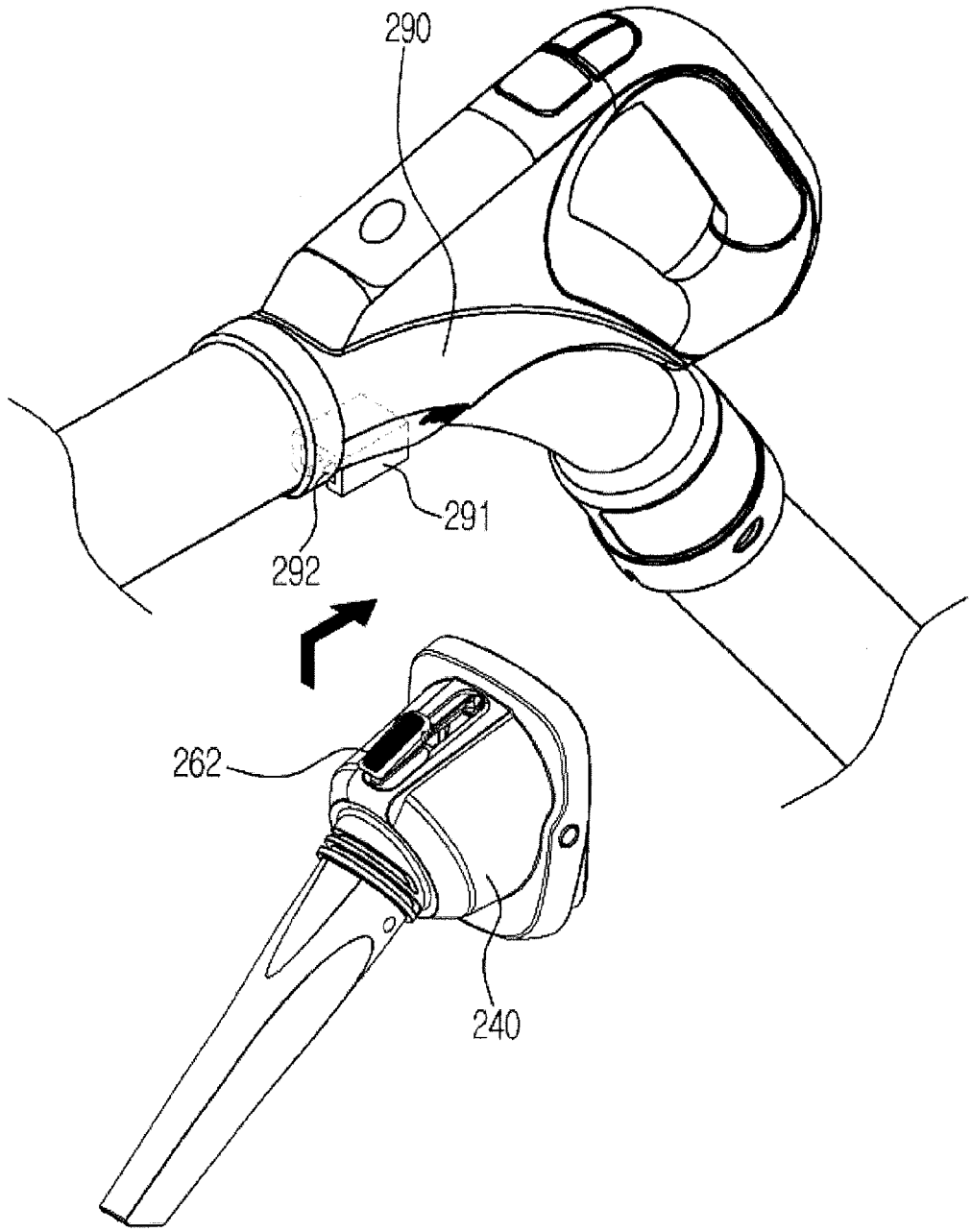
FIG. 13 is a drawing illustrating a handle pipe coupled to the accessory assembly of the cleaner in the third embodiment of the present disclosure.

FIG. 11 is a side view illustrating an accessory assembly of a cleaner in a third embodiment of the present disclosure, FIG. 12 is an exploded perspective view illustrating the configuration of the accessory assembly of the cleaner in the third embodiment of the present disclosure that is exploded, and FIG. 13 is a drawing illustrating a handle pipe coupled to the accessory assembly of the cleaner in the third embodiment of the present disclosure.

Hereinafter, an accessory assembly of a cleaner in accordance with the third embodiment of the present disclosure will be described with reference to FIGS. 11 to 13. In the following description, the same reference numerals will be assigned to the parts of the present embodiment that are identical to those according to the previous embodiment, and details of parts will be omitted in order to avoid redundancy.

An accessory assembly 240 of a cleaner in accordance with the third embodiment of the present disclosure has a slightly different shape from the first embodiment of the present disclosure, but fundamentally, has the same function as the first embodiment of the present disclosure.

The accessory assembly 240 includes an accessory body 250, a Crevice 270, a Dusting 260 and an Upholstery 280.

The Upholstery 280 includes a rotating shaft 281, and as the rotating shaft 281 is inserted into a rotating shaft accommodation part 251 of the accessory body 250, the Upholstery 280 rotates on the rotating shaft 281 with respect to the accessory body 250. Different from the first embodiment of the present disclosure, the Upholstery 280 in accordance with the third embodiment of the present disclosure is located inside the accessory body 250.

The Dusting 260 is provided with a brush 261 mounted thereon. The Dusting 260 is slidably coupled to the accessory body 250, and for such, the accessory body 250 includes a guide hole 253 formed in a longitudinal direction of the accessory body 250 to guide the movement of the Dusting 260. The Dusting 260 includes a manipulation part 262 that is moved along the guide hole 253 and is pressed by a user.

Meanwhile, the manipulation part 262 is coupled to a holder part 291 provided on the handle pipe 290 such that the accessory assembly 240 is supported by the handle pipe 290.

Here, the manipulation part 262 includes a coupling leg 265 inserted into a coupling groove 266 provided in the Dusting 260, an insertion protrusion 263 inserted into an accommodation groove 292 of the holder part 291, and a connection part 264 connecting the coupling leg 265 to the insertion protrusion 263.

As described above, the accessory assembly 240 in accordance with the third embodiment has the manipulation part 262, which is configured to manipulate the movement of the Dusting 260, provided on the holder part 291 of the handle pipe 290, so that the accessory assembly 240 is easily and simply supported by the handle pipe 290 without using an additional coupling structure.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A cleaner comprising:

a body configured to generate a suction force;

a suction head configured to suction air and dirt via the suction force;

a handle pipe including a manipulation part configured for manipulation by a user;

an extension pipe connecting the suction head to the handle pipe; and an accessory assembly configured to be coupled to the handle pipe to perform a cleaning in place of the suction head, the accessory assembly comprising an accessory body, a dusting tool on which a brush is mounted, a crevice tool to clean a gap, and an upholstery tool to clean fabrics;

wherein the upholstery tool is rotatably coupled to the accessory body, and the crevice tool is rotatably coupled to the accessory body so that an angle between a rotation axis of the crevice tool and a central axis of the accessory body is adjustable.

2. The cleaner of claim 1, wherein:

the upholstery tool comprises a rotating shaft that protrudes so as to be coupled to the accessory body, and the accessory body comprises a rotating shaft accommodation part into which the rotating shaft is inserted to allow the upholstery tool to be rotatably coupled to the accessory body.

3. The cleaner of claim 1, wherein the accessory body comprises a stopper part to limit a range of rotation of the upholstery tool.

4. The cleaner of claim 1, wherein:

the crevice tool is coupled to one end of the accessory body, and the upholstery tool is coupled to another end of the accessory body so as to be provided at an opposite side of the crevice tool with respect to the accessory body.

5. The cleaner of claim 1, wherein the dusting tool is coupled to an interior portion of the accessory body so as to be slid toward the upholstery tool.

6. The cleaner of claim 5, wherein:

the accessory body comprises a guide hole configured to guide a movement of the dusting tool, and the dusting tool comprises a manipulation part that is movable along the guide hole and that is configured to be pressed by the user.

7. The cleaner of claim 6, wherein the accessory body further comprises a locking hole provided at both ends in a longitudinal direction of the guide hole to lock the dusting tool.

8. The cleaner of claim 5, wherein:

the handle pipe is provided with a holder part to which the manipulation part is coupled, and the accessory assembly is supported by the handle pipe as a manipulation part is coupled to the holder part.

9. The cleaner of claim 8, wherein:

the holder part comprises an accommodation groove, and the manipulation part comprises an insertion protrusion that is inserted into the accommodation groove.

10. A cleaner comprising:

a body configured to generate a suction force;

a suction head configured to suction air and dirt via the suction force;

a handle pipe configured for manipulation by a user;

an extension pipe connecting the suction head to the handle pipe; and an accessory assembly coupled to the handle pipe to perform a cleaning in place of the suction head, the accessory assembly comprising an accessory body, a dusting tool on which a brush is mounted, a crevice tool to clean a gap, and an upholstery tool to clean fabrics, wherein the crevice tool is rotatably coupled to the accessory body so that an angle between a rotation axis of the crevice tool and a central axis of the accessory body is adjustable.

11. The cleaner of claim 10, wherein:

the accessory body comprises an annular groove, and the crevice tool comprises a coupling protrusion inserted into the annular groove.

12. The cleaner of claim 10, a central axis of the accessory body is not provided in line with a rotation axis of the crevice tool.

13. The cleaner of claim 10, wherein the crevice tool comprises a cap part rotatably coupled to the accessory body, and a nozzle part extending from the cap part.

14. The cleaner of claim 13, wherein the rotation axis of the crevice tool is not provided in line with a central axis of the nozzle part.

15. The cleaner of claim 10, wherein the crevice tool is rotatably coupled to the accessory body through a universal joint.

16. The cleaner of claim 15, wherein:

the crevice tool comprises a ball part having a spherical shape; and the accessory body comprises a ball housing to support and surround the ball part.

17. The cleaner of claim 16, wherein the ball part comprises an opening allowing an inside passage of the crevice tool to communicate with an inside passage of the accessory body.

18. The cleaner of claim 16, further comprising a packing member coupled between the ball part and the ball housing to maintain airtightness inside passages of the ball part and the ball housing while supporting the ball part.

19. An apparatus configured to attach to a handle pipe of a vacuum cleaner, the apparatus comprising:

an accessory assembly to perform a cleaning in place of a suction head of the vacuum cleaner, the accessory assembly comprising an accessory body, a dusting tool on which a brush is mounted, a crevice tool to clean a gap, and an upholstery tool to clean fabrics, the upholstery tool being rotatably coupled to the accessory body, wherein each of the accessory body, the dusting tool, the crevice tool, and the upholstery tool are integrally formed with each other as a single unit, and the crevice tool is rotatably coupled to the accessory body so that an angle between a rotation axis of the crevice tool and a central axis of the accessory body is adjustable.

* * * * *